US006072182A

United States Patent [19]

Chutjian et al.

[11] Patent Number: 6,072,182

[45] Date of Patent: Jun. 6, 2000

[54] HIGH-EFFICIENCY ELECTRON IONIZER FOR A MASS SPECTROMETER ARRAY

[75] Inventors: Ara Chutjian, La Crescenta; Murray R. Darrach, Arcadia; Otto J. Orient, Glendale, all of Calif.

[73] Assignee: California Institute of Technology, Pasadena, Calif.

[21] Appl. No.: 09/165,176

[22] Filed: Oct. 1, 1998

Related U.S. Application Data

[60] Provisional application No. 60/060,895, Oct. 3, 1997.

[51] Int. Cl.[7] ..... H01J 49/14

[52] U.S. Cl. ..... 250/427; 250/423 R; 250/288

[58] Field of Search ..... 250/427, 423 R, 250/288, 281

[56] References Cited

U.S. PATENT DOCUMENTS 4,943,718 7/1990 Haines et al. ..... 250/288

*Primary Examiner*—Kiet T. Nguyen
*Attorney, Agent, or Firm*—Fish & Richardson P.C.

[57] ABSTRACT

The present invention provides an improved electron ionizer for use in a quadrupole mass spectrometer. The improved electron ionizer includes a repeller plate that ejects sample atoms or molecules, an ionizer chamber, a cathode that emits an electron beam into the ionizer chamber, an exit opening for excess electrons to escape, at least one shim plate to collimate said electron beam, extraction apertures, and a plurality of lens elements for focusing the extracted ions onto entrance apertures.

19 Claims, 4 Drawing Sheets

HIGH-EFFICIENCY ELECTRON IONIZER FOR A MASS SPECTROMETER ARRAY

CROSS-REFERENCE TO RELATED APPLICATIONS

This application claims benefit of the priority of U.S. Provisional Application Ser. No. 60/060,895, filed Oct. 3, 1997 and entitled "High-Efficiency Electron Ionizer for a Mass Spectrometer Array."

ORIGIN OF INVENTION

The invention described herein was made in performance of work under a NASA contract, and is subject to the provisions of Public Law 96-517 (35 U.S.C. 202) in which the Contractor has elected to retain title.

TECHNICAL FIELD

The invention relates to an improved electron ionizer for a mass spectrometer array for the separation of ions with different masses.

BACKGROUND

A quadrupole mass spectrometer separates ions with different masses by applying a DC voltage and an rf voltage on four rods having circular or hyperbolic cross sections and an axis equidistant from each rod. Sample ions enter this cross sectional area through an aperture at the Ends of the rods. The variation of the applied rf voltages on the four rods selects sample ions of a certain mass-to-charge ratio (m/e) to exit the quadrupole mass spectrometer to be detected. Sample ions with different m/e values either impact the rods and are neutralized or deflected away from the axis of the quadrupole.

A miniature quadrupole mass spectrometer array is described in U.S. Pat. No. 5,596,193, the disclosure of which is herein incorporated by reference.

FIG. 1 shows a block diagram of a typical prior art quadrupole mass spectrometer 100 constructed of 16-rod electrodes 106 in a 4×4 array to form nine separate quadrupole regions. Ionization of a gas sample begins in an ionizer chamber within an ionizer 102. Sample atoms or molecules are injected into this chamber where they are intercepted by electron beams and are ionized to positive ions. These are then extracted through the entrance apertures 104 of the quadrupole mass spectrometer 100 and are detected.

Electron ionizers, as used in mass spectrometers, have applications in environmental monitoring, semiconductor etching, residual gas analysis in laboratory vacuum chambers, monitoring of manufacturing plants against toxic substances, protection of buildings, harbors, embassies, airports, military sites, and power plants against terrorist attacks.

SUMMARY

The inventors noticed that the existing electron ionizers are relatively inefficient. They found that the electron beams are not passing to a proper area, near enough to the entrance apertures 104. Hence, those apertures are "starved" for ions. Proportionately more electrons escape out the exit than are extracted as ions through the entrance apertures 104. Even those apertures that have coverage lack efficient ion transport means to optimally focus ions onto the quadrupolar regions.

The system disclosed herein meets these drawbacks by using an electron beam collimator, preferably, at least one shim plate 310, to collimate an electron beam 306 emitted from a cathode 302. The electron beam intercepts sample atoms and molecules ejected from a repeller plate 312 and ionizes them to positive ions. The ions are then extracted by static fields formed by a repeller plate 312 and a first lens element 316. Three lens elements 316, 408 and 410 extract and focus these ions onto entrance apertures 412.

BRIEF DESCRIPTION OF THE DRAWINGS

Like reference numbers and designations in the various drawings indicate like elements.

DETAILED DESCRIPTION

Figure 1:
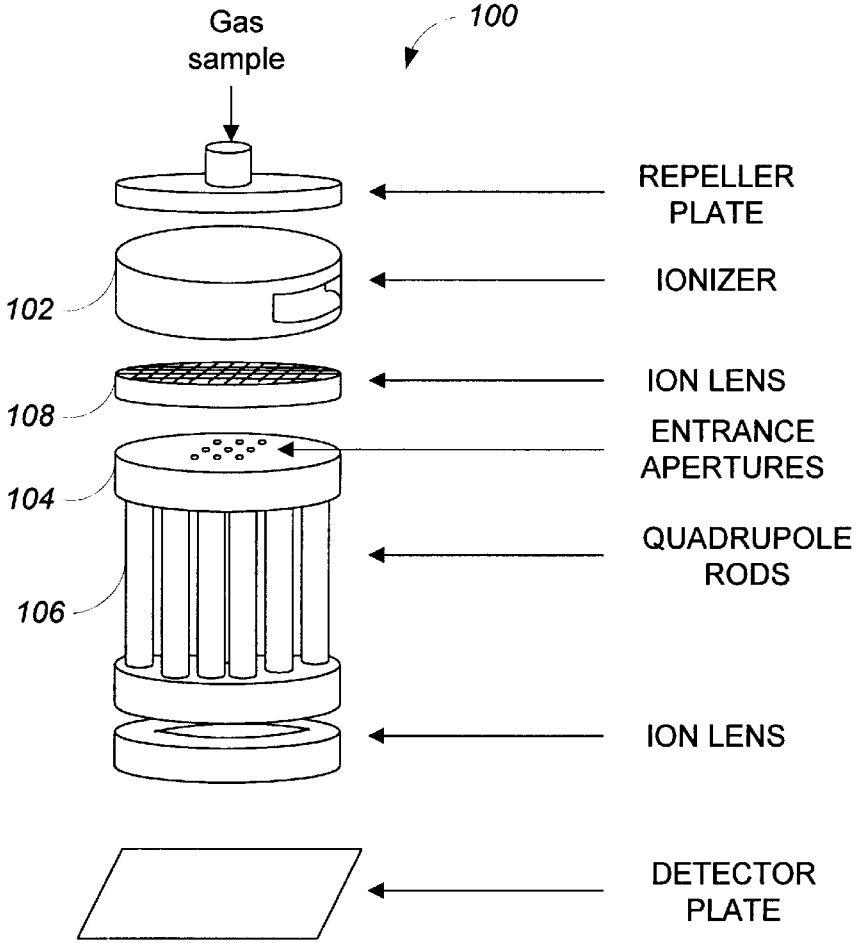
FIG. 1 (PRIOR ART)
FIG. 1 is a block diagram of a typical prior art quadrupole mass spectrometer constructed of 16-rod electrodes in a 4×4 array to form nine separate quadrupole regions.
Figure 2B:
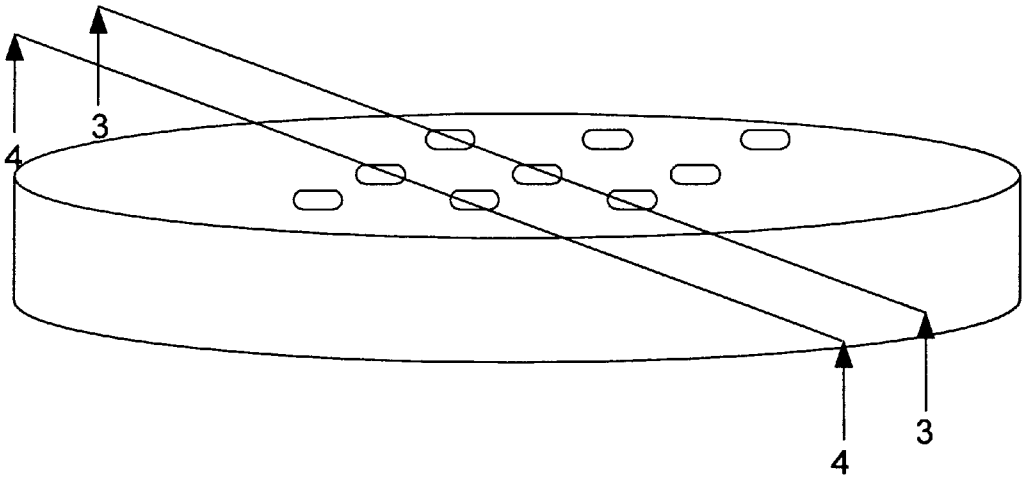
FIGS. 2A and 2B are block diagrams of an improved electron ionizer with a direction of cross-sectional views of FIGS. 3 and 4 shown.
Figure 2A:
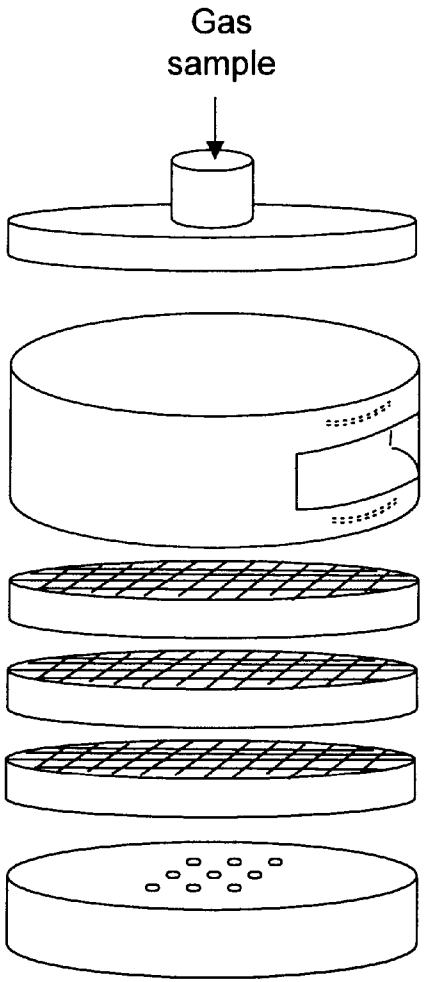
Figure 3:
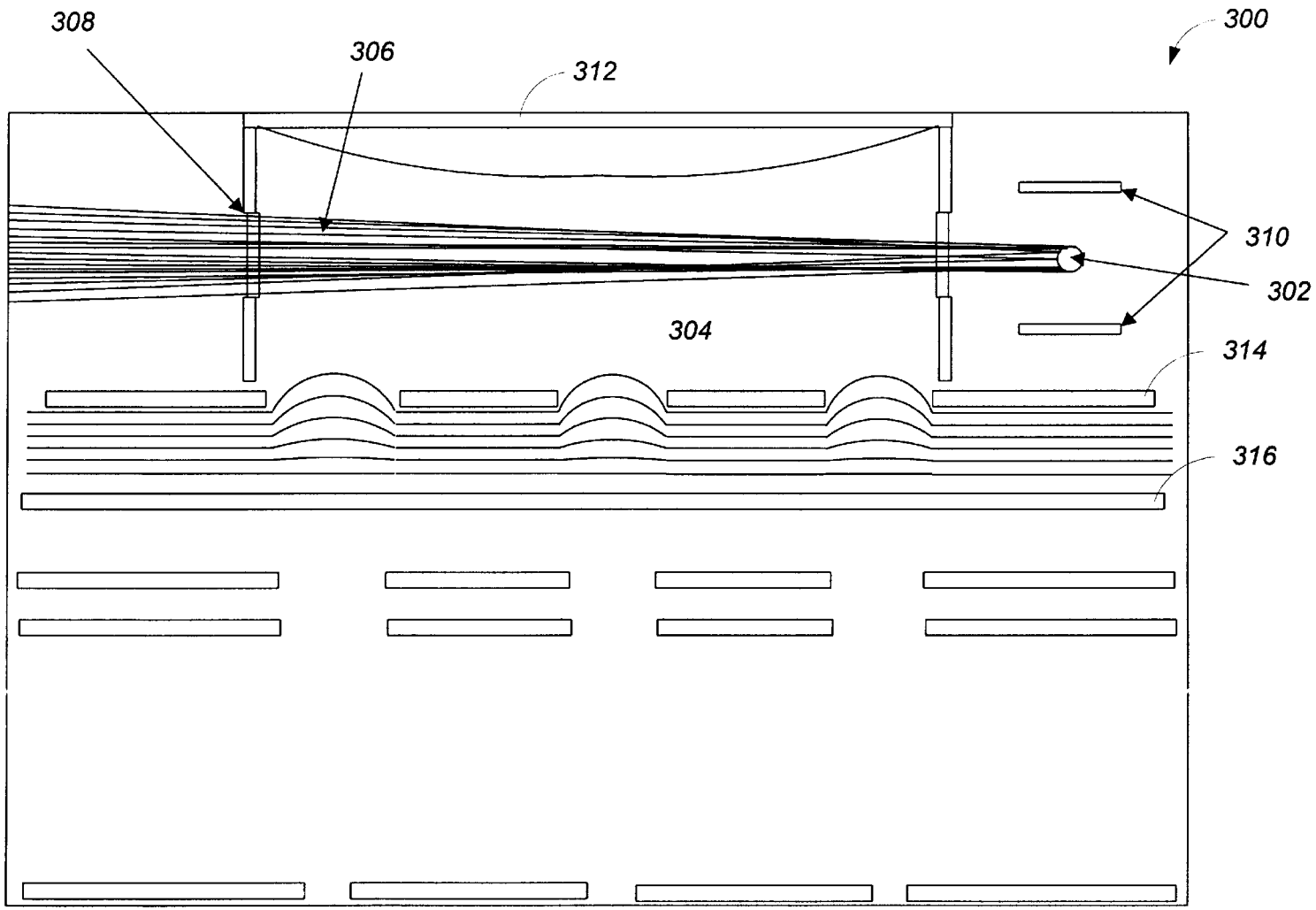
FIG. 3 is a cross-sectional view of an improved electron ionizer.
Figure 4:
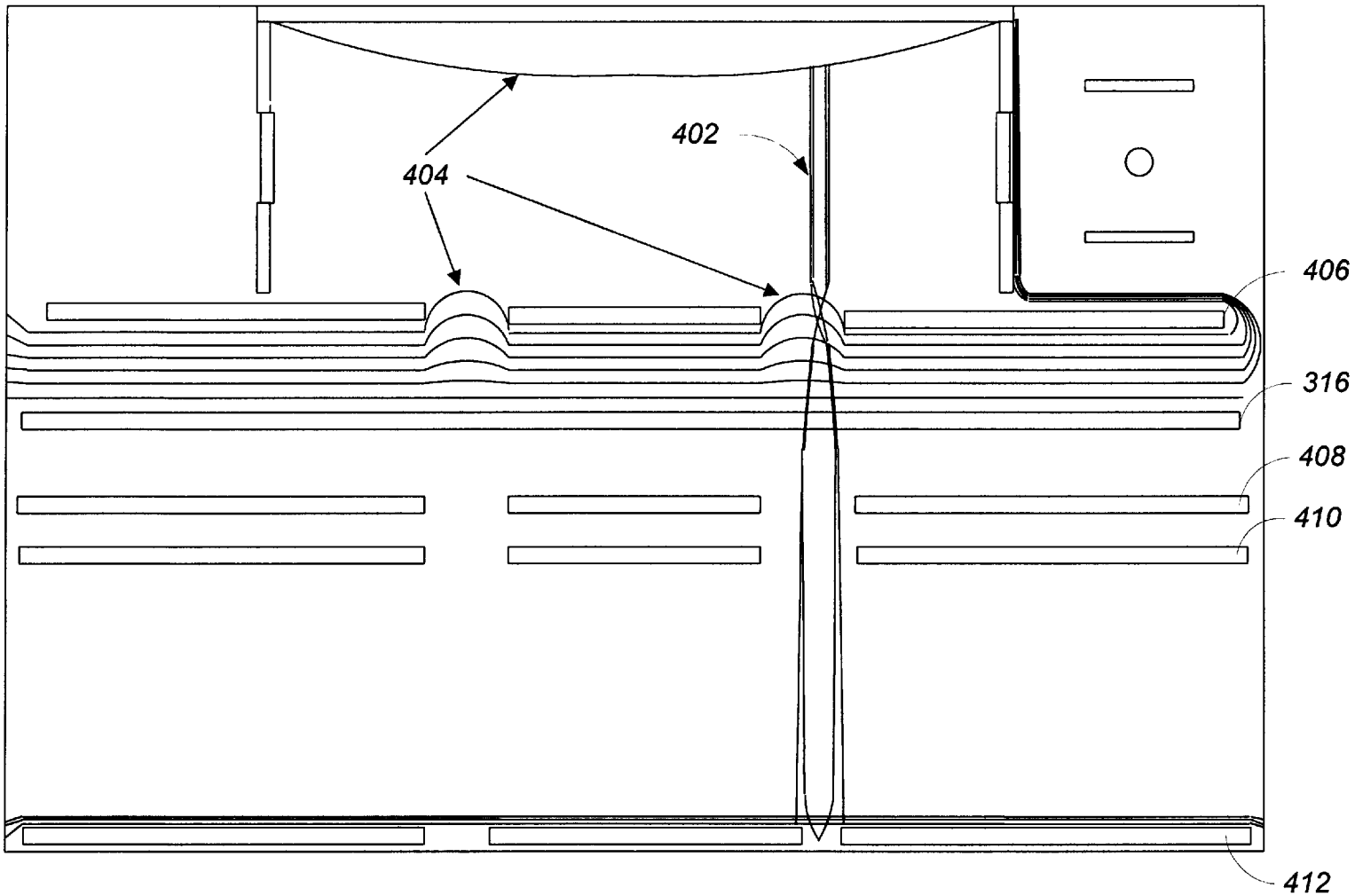
FIG. 4 is a different cross-sectional view of an improved electron ionizer with edge apertures shown.

The present disclosure describes an improved electron ionizer for use in a quadrupole mass spectrometer array. A diagram of an improved electron ionizer is shown in FIG. 2A with directions of cross-sectional views of FIGS. 3 and 4 shown in FIG. 2B. An improved electron ionizer 300, shown in FIG. 3, includes a repeller plate 312, an ionizer chamber 304, a cathode 302 that emits an electron beam 306 into the ionizer chamber 304, an exit opening 308 allowing for excess electrons to escape, at least one shim plate 310, extraction apertures 314, and a plurality of lens elements 316, 408 and 410 for focusing the extracted ions onto entrance apertures 412.

The cathode 302 is formed from a straight wire perpendicular to the plane of FIG. 3. The cathode 302 is biased at approximately −70 V relative to the ground. The cathode 302 emits an electron beam 306 into the ionizer chamber 304. Excess electrons not extracted as ions then exit through the opening 308 at the left end of the ionizer chamber 304. Typical emission currents used by the cathode 302 are 300 to 1000 $\mu$A. In a preferred mode, the cathode 302 uses an emission current of 500 $\mu$A. The electron beam 306 emitted from the cathode 302 is collimated by at least one shim plate 310. The at least one shim plate 310 is biased at approximately −100 V. In preferred embodiments, two shim plates 310 are provided. However, any device that focuses or collimates the electron beam toward the openings could be alternately used.

A repeller plate 312 ejects sample atoms and molecules toward grounded extraction apertures 314 filling the ionizer chamber 304. The electron beam 306 intercepts sample atoms and molecules and ionizes them to positive ions. The ions are then extracted by static fields which are set up by the geometry and potential of the repeller plate 312, and a first lens element 316. The repeller plate 312 is biased at approximately +2 V while the first lens element 316 is biased at approximately −8 V. Hence the beam is collimated to the right soot and the ions are pushed through the opening.

FIG. 4 shows trajectories of the positive ions 402 that are formed by the electron beam 306 and extracted by the static fields 404. A slightly different cross-section than FIG. 3 is taken to illustrate typical extraction difficulties experienced by edge extraction apertures 406. Also, the electron beam 306 is omitted for clarity. Appropriate geometry and potential of the repeller plate 312 and the first lens element 316 allow electron beam 306 to form ions above these edge extraction apertures 406. Lens elements 316, 408 and 410 then extract and focus these ions onto entrance apertures 412. A second lens element 408 is biased at approximately −25 V and placed at approximately 1 mm from the first lens element 316. A third lens element 410 is biased at approximately −200 V and placed at approximately 1 mm from the second lens element 408.

A number of embodiments of the present invention have been described. Nevertheless, it will be understood that various modifications may be made without departing from the spirit and scope of the invention. For example, while the invention has been described in terms of nine extraction apertures with cross-sectional figures showing two and three extraction apertures, the invention may be implemented with any number of extraction apertures. Also, while the invention has been described in terms of three lens elements, it may be implemented with any number of lens elements. Accordingly, other embodiments are within the scope of the following claims.

What is claimed is:

1. An improved electron ionizer for a quadrupole mass spectrometer comprising:

a repeller plate that ejects sample particles;

an ionizer chamber;

a cathode that emits an electron beam into said ionizer chamber, said ionizer chamber having an opening for excess electrons from the electron beam to exit;

a plurality of extraction apertures to extract ions from the electron beam;

an electron beam collimator, operating to collimate said electron beam near said extraction apertures; and a plurality of lens elements to focus the extracted ions, wherein the ions are extracted into the plurality of extraction apertures by static fields formed by said repeller plate and said lens elements.

2. The ionizer of claim 1, wherein the repeller plate is biased at approximately +2 V.

3. The ionizer of claim 1, wherein the cathode is biased at approximately −70 V.

4. The ionizer of claim 3, wherein the cathode is biased at approximately 500 $\mu$A.

5. The ionizer of claim 1, wherein the collimator includes at least one shim plate which is biased at approximately −100 V.

6. The improved electron ionizer for a quadrupole mass spectrometer of claim 1, wherein the plurality of lens elements comprising:

a first lens element;

a second lens element placed at approximately 1 mm from the first lens element; and a third lens element placed at approximately 1 mm from the second lens element.

7. The ionizer of claim 6, wherein the first lens element is biased at approximately −8 V, the second lens element is biased at approximately −25 V and the third lens element is biased at approximately −200 V.

8. An improved electron ionizer for a quadrupole mass spectrometer comprising:

a repeller plate that ejects sample particles;

an ionizer chamber;

a cathode that emits an electron beam into said ionizer chamber, said ionizer having an opening for excess electrons from the electron beam to exit;

a plurality of extraction apertures placed to extract ions from the electron beam;

an electron beam collimator, operating to collimate said electron beam near said extraction apertures;

a first lens element, wherein the ions are extracted into the plurality of extraction apertures by static fields formed by said repeller plate and said first lens element;

a second lens element placed at approximately 1 mm from the first lens element; and a third lens element placed at approximately 1 mm from the second lens element, wherein the three lens elements focus the extracted ions into entrance apertures.

9. The ionizer of claim 8, wherein the repeller plate is biased at approximately +2 V.

10. The ionizer of claim 8, wherein the cathode is biased at approximately −70 V.

11. The ionizer of claim 10, wherein the cathode is biased at approximately 500 $\mu$A.

12. The ionizer of claim 8, wherein the collimator includes at least one shim plate which is biased at approximately −100 V.

13. The ionizer of claim 8, wherein:

the first lens element is biased at approximately −8 V;

the second lens element is biased at approximately −25 V; and the third lens element is biased at approximately −200 V.

14. An improved electron ionizer for a quadrupole mass spectrometer comprising:

a repeller plate that ejects sample particles;

an ionizer chamber;

a cathode that emits an electron beam into said ionizer chamber, said ionizer chamber having an opening for excess electrons from the electron beam to exit;

a plurality of extraction apertures to extract ions from the electron beam;

a plurality of shim plates to collimates said electron beam near said extraction apertures;

a first lens element, wherein the ions are extracted into the plurality of extraction apertures by static fields formed by said repeller plate and said first lens element;

a second lens element placed at approximately 1 mm from the first lens element; and a third lens element placed at approximately 1 mm from the second lens element, wherein the three lens elements focus the extracted ions into entrance apertures.

15. The ionizer of claim 14, wherein the repeller plate is biased at approximately +2 V.

16. The ionizer of claim 14, wherein the cathode is biased at approximately −70 V.

17. The ionizer of claim 16, wherein the cathode is biased at approximately 500 $\mu$A.

18. The ionizer of claim 14, wherein the plurality of shim plates are biased at approximately −100 V each.

19. The ionizer of claim 14, wherein:

the first lens element is biased at approximately −8 V;

the second lens element is biased at approximately −25 V; and the third lens element is biased at approximately −200 V.

* * * * *